United States Patent [19]

Borst et al.

[11] 3,962,955

[45] June 15, 1976

[54] POWER TRIM-TILT SYSTEM

[75] Inventors: Gaylord M. Borst, Waukegan; Martin H. Meyer, Libertyville, both of Ill.

[73] Assignee: Outboard Marine Corporation, Waukegan, Ill.

[22] Filed: Mar. 12, 1974

[21] Appl. No.: 450,465

Related U.S. Application Data

[62] Division of Ser. No. 320,913, Jan. 4, 1973, Pat. No. 3,885,517.

[52] U.S. Cl. ..... 91/401; 92/113

[51] Int. Cl.[2] ..... F15B 15/22

[58] Field of Search ..... 91/401; 92/113, 181

[56] References Cited

UNITED STATES PATENTS

| | | | |
|---|---|---|---|
| 2,902,007 | 9/1959 | Rockwell | 91/401 |
| 2,993,474 | 7/1961 | Ladd | 91/401 X |
| 3,004,524 | 10/1961 | McCay et al. | 91/401 X |
| 3,450,006 | 6/1969 | White | 91/401 |
| 3,572,215 | 3/1971 | Harris | 91/401 X |

FOREIGN PATENTS OR APPLICATIONS

| | | | |
|---|---|---|---|
| 23,242 | 11/1955 | Germany | 92/113 |

*Primary Examiner*—Irwin C. Cohen
*Attorney, Agent, or Firm*—Michael, Best & Friedrich

[57] ABSTRACT

Disclosed herein is a marine propulsion device comprising a tilt hydraulic cylinder-piston assembly connected between a first member adapted to be attached to a boat and a second member connected to the first member for vertical swinging movement relative to the boat, and a trim hydraulic cylinder-piston assembly connected to the first and second members. Also provided is a hydraulic system connected to the tilt and trim hydraulic cylinder-piston assemblies for pressurization thereof.

In one embodiment, the trim assembly includes a cylinder, a piston assembly located in the cylinder and having a first piston with a port therein and a second piston spaced axially from and fixedly connected to the first piston, together with a piston rod, means connecting the piston assembly to the piston rod for limited relative movement therebetween, valve means normally closing the port, and means for operating the valve means to open the port upon movement of the piston assembly to a predetermined position.

In another embodiment, the trim assembly includes a cylinder, a piston assembly located in the cylinder, together with a piston rod, and means connecting the piston assembly to the piston rod for limited relative movement therebetween.

2 Claims, 6 Drawing Figures

POWER TRIM-TILT SYSTEM

This application is a division of my application Ser. No. 320,913 filed Jan. 4, 1973, now U.S. Pat. No. 3,885,517.

BACKGROUND OF THE INVENTION

The invention relates generally to marine propulsion devices such as outboard motors and stern drive units, and, more particularly, to hydraulic arrangements for trimming and tilting the propulsion units of such devices.

Attention is directed to the Moberg U.S. Pat. No. 3,581,702, issued June 1, 1971, to the Cass U.S. Pat. No. 3,116,710, issued Jan. 7, 1964, and to the Bergstedt U.S. Pat. No. 3,548,777, issued Dec. 22, 1970.

Attention is also directed to the North U.S. Pat. No. 3,285,221, issued Nov. 15, 1966, to the Woodfill U.S. Pat. No. 3,434,448, issued Mar. 25, 1969, and to the McCormick U.S. Pat. No. 3,434,450, issued Mar. 25, 1969.

Attention is still further directed to the the Carpenter U.S. application Ser. No. 118,134, filed Feb. 23, 1971, now U.S. Pat. No. 3,722,455, and to the Meyer et al. U.S. application Ser. No. 313,521, filed Dec. 8, 1972, now U.S. Pat. No. 3,839,986.

SUMMARY OF THE INVENTION

The invention provides a hydraulic system for trimming and tilting the propulsion unit of a marine propulsion device. More specifically, the invention provides a hydraulic system including both a tilt hydraulic cylinder-piston assembly and a trim hydraulic cylinder-piston assembly, both of which assemblies are pivotally connected to both a bracket or member fixed to a boat hull and to a bracket or member which is vertically swingable relative to the boat hull and which supports a propulsion unit. One cylinder-piston assembly includes a piston which is movable within an associated cylinder and means for preventing fluid flow within the cylinder from one side of the piston to the other.

The other cylinder-piston assembly also includes a piston operable within a cylinder, together with means selectively operable in response to the position of the propulsion device for affording hydraulic fluid flow from one side of the piston to the other.

Still further in accordance with the invention, the hydraulic system includes a reversible electric pump and a conduit system including first and second flow ports controlled in response to operation of the pump, and first and second conduit means which extend respectively from the first and second flow ports and which communicate respectively with the opposite ends of the tilt cylinder-piston assembly and respectively with one end of the trim cylinder-piston assembly.

Still further in accordance with the invention, there is provided a manual relief valve which is operable to "short circuit" the conduit system so as to permit manual tilting of the propulsion unit. Means are also provided in accordance with the invention for normally locking the hydraulic system when the pump is not operating. In addition, means are also provided for absorbing shock and venting pressure fluid from the conduit means when the pressures therein become excessive as, for instance, upon the striking of an underwater obstacle, and during continued pump operation and after full travel of the propulsion unit.

More particularly, in one embodiment of the invention, the trim cylinder-piston assembly includes a trim piston assembly which includes two pistons spaced axially within a trim cylinder, fixed relative to one another, and movable relative to a piston rod. In addition, means are provided for permitting fluid flow from one side of one of the pistons to the other. More specifically, one of the pistons includes a port which is controlled by a valve member such that the port is normally closed but opens when the piston assembly approaches one end of the trim cylinder. In addition, said end of the trim cylinder is vented to the atmosphere and the other end of the trim cylinder, adjacent to the ported piston, includes a fitting which is connected to the flow port communicating with the flow port associated with the lower end of the tilt assembly. Another or intermediate pressure fluid fitting is mounted on the trim cylinder in position to communicate with the annular area between the pistons when the port is open. The other fluid fitting communicates with the flow port associated with the upper end of the tilt cylinder, subject to the control of a check valve which serves to prevent flow to the trim cylinder and to allow flow from the trim cylinder after full extension of the tilt cylinder and during continued pump operation.

In another embodiment in accordance with the invention, the tilt cylinder includes means operative to effect fluid flow from one side of the tilt piston to the other when the propeller unit is operating with excessive thrust when in the tilt range. More specifically, in accordance with the invention, the tilt piston and piston rod are provided with an axially extending bore in which there is located a hollow valve guide. Projecting from the associated end of the tilt cylinder is a valve stem which, when the propeller unit is in the trim range, projects into the valve guide and which includes a seal member which engages the inner wall of the valve guide. However, when the propeller unit is in the tilt range, the seal between the valve guide and valve stem is discontinued and the interior of the valve guide is subject to fluid pressure generated by forward thrust operation of the propeller. When such thrust becomes excessive, relief is provided by a check valve which is carried on the axially inner end of the valve guide and which is communicable with the other side of the tilt piston.

One of the principal objects of the invention is the provision of a hydraulic system for tilting and trimming a marine propulsion unit.

Another of the principal objects of the invention is provision of a tilt and trim hydraulic system which is powered by a single reversible electric pump and which includes two hydraulic cylinder-piston assemblies which are both connected to both of a bracket fixedly attached to a boat and a bracket which is vertically swingable relative to the fixed bracket.

Another of the principal objects of the invention is the provision of a trim hydraulic cylinder-piston cylinder employing a ported piston assembly operable in a cylinder having an intermediate fluid fitting.

Another of the principal objects of the invention is the provision of a tilt hydraulic cylinder-piston cylinder employing means for passing hydraulic fluid from one side of the piston to the other when excessive pressure is developed by a propeller operating in a forward thrust condition when the propulsion device is in the tilt range.

Another of the principal objects of the invention is provision of a marine propulsion device including a hydraulic cylinder-piston assembly having a piston rod movable relative to a piston located within a cylinder.

Another of the principal objects of the invention is provision of a hydraulic cylinder-piston assembly including a piston rod movable relative to a piston assembly which is located within a cylinder and which includes axially spaced and fixedly connected pistons, with one of the pistons including a valve controlled port.

Another of the principal objects of the invention is the provision of a hydraulic cylinder-piston-assembly as referred to in the preceding paragraph in which the valve controlled port is opened in response to movement of the piston assembly and in which the open port communicates with fluid fittings on each side of the piston containing the port, and in which the cylinder includes an air vent on the side of the piston assembly opposite from the piston including the port.

Another of the principal objects of the invention is the provision of a marine propulsion device including a hydraulic system which is selectively operable to trim and tilt a propulsion unit.

Other objects and advantages of the invention will become known by reference to the following description, claims, and drawings.

DRAWINGS

Figure 2:
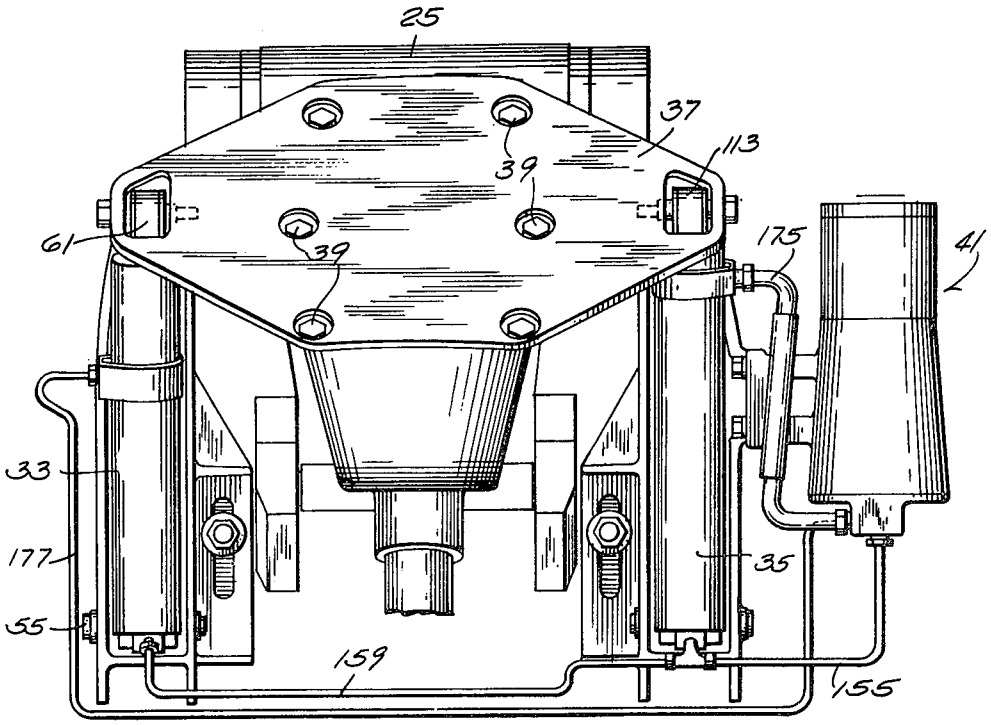
FIG. 2 is a fragmentary view taken generally along line 2—2 of FIG. 1 and illustrating various features of the invention.

Before explaining the invention in detail it is to be understood that the invention is not limited in its application to the details of construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Shown in the drawings is a marine propulsion device which is in the form of an outboard motor 11 (although the invention is also applicable to stern drive units) which outboard motor 11 includes a transom bracket 13 adapted to be fixed, as by bolting or otherwise, to a boat transom 15 and which includes a lower portion 17 and an upper portion 19 which can be either integral with the lower portion 17 or a separate part suitably fixed thereto, as by bolts 21.

The upper portion 19 of the transom bracket 13 supports a tilt pin 23 which, in turn, supports a swivel bracket 25 for vertical swinging movement relative to the transom bracket 13. In turn, the swivel bracket 25 supports a propulsion unit 27 including a propeller 29 for steering movement about an axis transverse to the axis of the tilt pin 23. The propulsion unit is vertically swingable, in common with the swivel bracket 25, between a lowermost position and a most elevated position through a trim range which begins at the lowermost position and extends therefrom through a limited arcuate range and through a tilt range which extends from the upper end of the trim range to the most elevated position.

In accordance with the invention, a hydraulic system 31 (See Fig. 3) is provided for trimming and tilting the propulsion unit 27 and for affording upward movement of the propulsion unit 27 in response to the striking of an underwater obstacle.

In accordance with the invention, the hydraulic system 31 includes first and second hydraulic cylinder-piston assemblies 33 and 35 which, at their lower ends, are pivotally connected to the lower portion of the transom bracket 13 and which, at their upper ends, are pivotally connected to the swivel bracket 25 through an attachment bracket 37 which is bolted at 39 or otherwise fixed to the swivel bracket 25. Alternatively, the attachment bracket 37 can be integrally formed on the swivel bracket 25. As is illustrated in the drawings, the pivotal connections of the first and second hydraulic cylinder-piston assemblies 33 and 35 to the transom bracket 13 are preferably transversely aligned and the pivotal connections of the first and second hydraulic cylinder-piston assemblies 33 and 35 to the attachment bracket 37 or swivel bracket 25 are preferably transversely aligned and located above and rearwardly of the pivotal connections to the transom bracket 13.

The hydraulic system 31 also includes an electrically operated reversible pump 41 with an associated sump 43 and a main control valve operable in response to pressurized fluid and movable relative to two oppositely located first and second flow control ports 47 and 49, together with a conduit system 51 which connects the flow control ports 47 and 49 to the first and second hydraulic cylinder-piston assemblies 33 and 35.

More particularly, the first or trim hydraulic cylinder-piston assembly 33 comprises a trim cylinder 53 which, in the illustrated construction, is closed at its lower end and includes an eye 55 which is pivotally attached to the transom bracket 13. At its upper end, the trim cylinder is closed by a threaded plug 57 through which there extends a piston rod 59 having, at its upper end, an eye 61 which is pivotally connected to the attachment bracket 37 or swivel bracket 25.

Contained within the trim cylinder 53 is a trim piston assembly 63 comprising two axially spaced upper and lower pistons 65 and 67 respectively which are each preferably provided with a suitable piston ring 69 and which are fixedly connected together by a tubular sleeve or tube 71 which includes a portion 73 projecting downwardly from the lower piston 67 toward the lower end of the trim cylinder 53.

Means are provided for adjusting the location of the piston assembly 63 in the trim cylinder 53 when the first hydraulic piston-cylinder assembly 33 is fully contracted. While other constructions could be employed, in the illustrated construction, the lower end of the sleeve 71 is closed by a threaded plug or member 75 having an enlarged head 77 adapted to engage the lower end of the trim cylinder 53 when the first hydraulic cylinder-piston assembly 33 is fully contracted.

Means are provided for connecting the trim piston assembly 63 to the pisoton rod 59 so as to provide free relative axial movement therebetween. While other constructions could be employed, in the illustrated construction, such means comprises sliding receipt of the lower end of the piston rod 59 within the hollow interior of the piston assembly sleeve or tube 71.

Means are provided for guiding relative axial movement between the trim piston assembly 63 and the piston rod 59. While other constructions could be employed, in the illustrated construction, such means comprises an apertured guide bushing or plate 79 which is bolted or otherwise mounted to the top of the upper piston 65 and through which the piston rod 59 is supported for axial movement. In addition, the lower end of the piston rod 59 includes a bushing 81 which is in engagement with the interior wall of the axial bore of the piston assembly sleeve 71 and which is additionally adapted to engage the under surface of the plate 79 to prevent withdrawal of the piston rod 59 from the piston assembly 63.

Means are provided for effecting common movement of the piston rod 59 with the piston assembly 63 during outward trimming operation. While other arrangements are possible, in the illustrated construction, such means comprises engagement of the lower end of the piston rod 59 with the interior wall of the closed bottom of the trim piston assembly sleeve 71.

In particular in accordance with the invention, means are provided for by-passing fluid from one side of the lower piston to the other when the propulsion unit is in the tilt range. More specifically, the lower piston 67 includes one or more valve controlled axially extending flow ports 83. While other valving arrangements are possible, in the illustrated construction, there is provided a valve member 85 which is movable relative to a position closing the port 83 and which includes a valve stem 87 extending through the port 83 and through guide bores 89 in the upper piston 65 and guide plate 79. Seal means can be provided to prevent loss of fluid around the valve stem and through the guide bores 89 in the upper piston 65 and guide plate 79.

Means are provided for biasing the valve member 83 to the closed position. While other arrangements are possible, in the illustrated construction, such means comprises a biasing compression spring 91 which, at one end, bears against the upper surface of the power piston 67 and, at its upper end, bears against the lower surface of a snap ring 93 assembled on the valve stem 87.

The upper and lower pistons 65 and 67 are spaced apart at such distance as will enable communication between the annular area 95 between the pistons 65 and 67 and a hydraulic fitting 97 located in the side wall of the trim cylinder 53 when the piston assembly 63 is located adjacent to the plug 57. In addition, the upper and lower pistons 65 and 67 are spaced so that the upper piston 65 will engage the threaded plug 57 when the propulsion unit is at the upper end of the trim range.

The second or tilt hydraulic cylinder-piston assembly 35 comprises a tilt cylinder 101 which is closed at its lower end and which includes an eye 103 pivotally connected to the transom bracket 13. The second hydraulic cylinder-piston assembly 35 also includes a non-apertured piston 105 which is slidable in the tilt cylinder 101, which is connected to a piston rod 109 for common movement therewith, and which is preferably provided with a piston ring 107 so as to prevent fluid flow from one side to the other of the piston 105. The piston rod 109 passes out of the tilt cylinder 101 through a plug 111 screwed into the cylinder top and is provided, at its upper or outer end, with an eye 113 which is pivotally connected to the attachment bracket 37 or swivel bracket 25. Suitable seals can be provided between the piston rod 109 and the plug 111.

Figure 3:
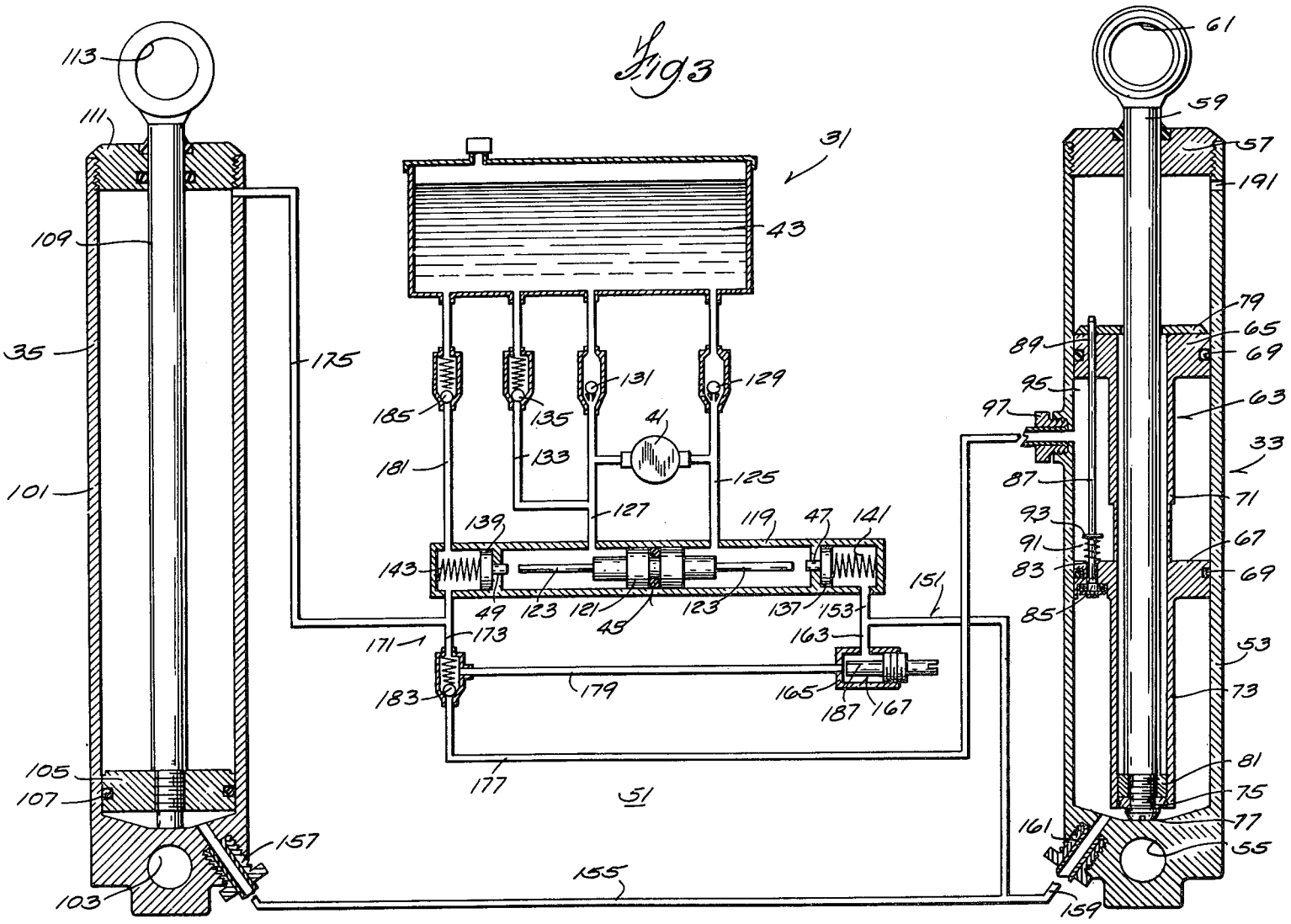
FIG. 3 is a schematic view illustrating the hydraulic system incorporated in the marine propulsion device shown in FIGS. 1 and 2.

While other constructions are possible, in the illustrated construction as shown best in FIG. 3, the main control valve 45 comprises a spool which is shiftable axially in a closed tubular valve housing 119 and which includes a central piston portion 121 and two oppositely extending plunger portions 123. A seal is preferably provided between the piston portion 121 and the valve housing 119. The main valve housing 119 is connected to the opposite sides of the pump 41 by respective flow passageways or ducts 125 and 127 which extend from ports in the valve housing 119 on opposite sides of the piston portion 121 of the spool 45. The ducts 125 and 127 communicate with the sump 43 subject to the action of respective ball check valves 129 and 131 which selectively permit flow from the sump 43 and prevent flow to the sump 43. In addition, the duct 127 communicates with a duct 133 which includes a spring biased check valve 135 preventing flow from the sump 43 to the duct 127 but affording flow from the duct 127 to the sump 43 in the event of a pressure in the duct 127 above a predetermined level which will hereafter be referred to.

Provided in the main valve housing 119 in opposite relation to each other on opposite sides of the spool 45 are the first and second flow control ports 47 and 49 which are each provided with respective valve members 137 and 139 biased by respective springs 141 and 143 into closed positions, as shown in FIG. 3.

The conduit system 51 includes a first conduit means 151 which generally communicates between the first flow port 47 and the lower part of the cylinders 53 and 101 and which includes a main duct 153 communicating with the first flow port 47, a branch duct 155 communicating with the main duct 153 and with a fitting 157 communicating with the lower end of the tilt cylinder 101, a second branch duct 159 communicating with the main duct 153 and with a fitting 161 communicating with the lower end of the trim cylinder 53, and a third branch duct 163 communicating with the main duct 153 and with a housing 165 for a manual release valve 167.

The conduit system 51 also includes a second conduit means 171 which communicates with the second flow port 49 and which includes a main duct 173 communicating with the second flow port 49, a first branch duct 175 communicating with the main duct 173 and with the upper end of the tilt cylinder 101, a second branch duct 177 communicating with the main duct 173 and with the fitting 97 in the trim cylinder 53, a third branch duct 179 communicating with the main duct 173 and with the release valve housing 165, and a fourth branch duct 181 communicating with the main duct 173 and with the sump or reservoir 43.

The first conduit means is generally free of restrictions to flow. However, in accordance with the invention, the second conduit means 171 includes flow control means in the second branch duct 177 including a spring biased check valve 183 which prevents flow to the trim cylinder 53 and which affords flow from the trim cylinder 53 in response to the presence of a greater, predetermined fluid pressure in the second branch duct 177 than in the main duct 173.

The fourth branch duct 181 also includes a spring biased check valve 185 preventing flow from the sump 43 to the main duct 173 and permitting flow from the main duct 173 to the sump.

The manual release valve 167 comprises a valve member 187 which is rotatable within the housing 165 between a first or open position affording communication between the third branch duct 163 of the first conduit means 151 and the third branch duct 179 of the second conduit means 171, thereby to short circuit the hydraulic system 31, and a second or closed position preventing such communication. When the manual release valve 167 is open, the propulsion unit 27 and connecting swivel bracket 25 can be manually raised and lowered.

While the fit between the piston rod 59 and the plug 57 will normally permit air flow out of the top of the trim cylinder 53 so as to prevent pneumatic locking of the first cylinder-piston assembly 33, if desired, the upper part of the trim cylinder 53 above the piston assembly 33 can be placed in communication with the atmosphere through a vent hold 191.

In oeration, to provide trim adjustment in the upward direction, the pump 41 is operated to provide pressure fluid through the duct 125. In the spool valve housing 119, such pressure fluid serves to displace the spool 45 to the left, as seen in FIG. 3, and thereby to open the second flow port 49 by reason of engagement of the left plunger 123 against the valve member 139. In addition, such pressurized fluid in the spool valve housing 119 acts to open the first flow port 47 by displacing the valve member 137 out of the first flow port 47 and to consequently provide pressure fluid to the first conduit means 151 and delivery of pressure fluid to the lower part of each of the trim and tilt cylinders 53 and 101, thereby extending the cylinder-piston assemblies 33 and 35 and raising the propulsion unit 27 and connected swivel bracket 25 through the trim range. During upward movement through the trim range, the pressure fluid in the top of the tilt cylinder 101 exits through the second conduit means 171, through the second flow port 49, and through the duct 127 to the suction side of the pump 41.

In addition, during upward movement in the trim range, the valve member 85 in the piston assembly 63 retains the port 83 closed under the action of the spring 91.

As the propulsion unit 27 and connected swivel bracket 25 approach the upper end of the trim range, the piston assembly 63 approaches the upper end of the trim cylinder 53 and the valve stem 87 engages the plug 57 in the trim cylinder 53 to cause opening of the port 83 in the piston assembly 63. Such opening permits flow of pressure into the annular area 95 between the upper piston 65 and the lower piston 67 and out through the fitting 97 and into the second branch duct 177 of the second conduit means 171. However, the spring biasing the control or check valve 183 in the second branch duct 177 is designed so as to open only when the pressure in the second branch duct 177 is above the level which will normally be effective to cause extension of the tilt cylinder-piston assembly 35 and consequent tilting of the propulsion unit 27 and connected swivel bracket 25. Thus, during movement through the tilt range, the control valve 183 remains closed and the entire fluid output of the pump 41 is directed to the tilt cylinder 101. During such extension of the tilt cylinder-piston assembly 35 in the tilt range, the piston rod 59 of the trim cylinder-piston assembly 33 withdraws from the sleeve 71 of the piston assembly 63. In addition, the check valve 183 serves to limit the load supported by the tilt cylinder when the propulsion unit is in the tilt range. Specifically, if the load supported by the tilt cylinder becomes excessive, the resulting pressure developed in the lower part of the tilt cylinder is communicated through the branch duct 155 to the trim cylinder and then through the branch duct 177 to the check valve 183 which then provides pressure relief by opening.

When the upper end of the tilt range is reached, the tilt piston 105 engages the plug 111 in the tilt cylinder 101, and further operation of the pump 41 serves only to increase the pressure in the hydraulic system 31 to the point where the control or check valve 183 in the second branch duct 177 of the second conduit means 171 opens to permit flow of pressure fluid through the branch duct 179 of the first conduit means 151, through the port 83 in the piston assembly 63 and through the second branch 177 of the second conduit means 171, past the control or check valve 183 into the main duct 173 of the second conduit means 171, and through the second flow port 49 and through the spool valve housing 119 and duct 127 to the suction side of the pump 41. Thus, the hydraulic system 31 is automatically short circuited.

When the pump 41 is turned off, the springs 141 and 143 at the opposite ends of the spool valve housing 119 operate to cause both valve members 137 and 139 to close both flow ports 47 and 49 and to hydraulically lock the propulsion unit 27 and connected swivel bracket 25 against further movement in the absence of pump operation or movement of the release valve 167 to the open position. Accordingly, in order to lower the propulsion unit 27 and connected swivel bracket 25, the pump 41 is operated in the other direction to pressurize the duct 127, and the spool valve housing 119 so as to displace the spool 45 to the right and to open the first flow port 47 by engagement of the right plunger 123 with the valve member 137. In addition, the pressure fluid in the housing 119 serves to open the second flow port 49 to enable pressure fluid flow through the second conduit means 71 and, in particular, through the first branch duct 175 to the top of the tilt cylinder 101. Flow of pressure fluid to the top of the tilt cylinder 101 serves to displace the tilt piston 105 downwardly and to lower the propulsion unit 27 and connected swivel bracket 25. As the first flow port 47 is opened by operation of the spool 45, the pressure fluid in the lower part of each of the cylinders 53 and 101 is free to return through the first conduit means 151 and through the duct 125 to the suction side of the pump 41.

Flow of pressurized fluid through the fourth branch duct 181 of the second conduit means 171 and into the sump 43 is normally prevented by the check valve 185. However, in the event the propulsion unit 27 strikes an underwater obstacle, the pressure in the second conduit means 171 will rise very rapidly and will consequently cause opening of the check valve 185 in the fourth branch duct 181 to communicate the second conduit means 171 with the sump 43 and to permit oil to flow out of the top of the tilt cylinder 101 so as to permit upward swinging of the propulsion unit 27 and connected swivel bracket 25. When the obstacle is passed, the propulsion unit 27 and connected swivel bracket 25 are free to return by gravity to the previously set position as there has been no change in the quantity of oil in the lower parts of the cylinders 53 and 101. In addition, the spring loaded check valve 185 is designed so as to resist opening and to permit limited transmission of thrust through the tilt cylinder 101 when the outboard motor is operating in reverse. However, attempted excessive thrust transmission in reverse will result in opening of the check valve 185 with resultant upward movement of the propulsion unit 27.

The spring loaded check valve 135 serves as a pressure relief valve and limits the pressure produced when pumping down as very little pressure is needed due to the weight of the propulsion unit. More specifically, under normal conditions, the spring biasing the check valve 135 retains the check valve 135 closed. However, when the tilt piston 105 bottoms out at the bottom of the tilt cylinder 101 or should there be some obstruction to downward movement of the propulsion unit 27 and connected swivel bracket 25, the spring associated with the check valve 135 is designed to afford opening of the check valve 135 when the pressure in the second conduit means 171 rises a predetermined amount above that normally effective to cause lowering of the propulsion unit 27 and connected swivel bracket 25.

As the amount of pressure fluid drained from the bottom of the tilt cylinder 101 during the lowering of the propulsion unit 27 and connected swivel bracket 25 is greater than that which is supplied to the top of the tilt cylinder 101, the excess oil drained from the tilt cylinder 101 pressurizes the suction side of the pump 41 and is delivered under pump pressure to the sump 43 through the check valve 135. Also during lowering of the propulsion unit through the tilt range, the piston rod 59 is telescoped into the piston assembly 63 by mechanical action of the connection of the trim cylinder assembly between the swivel bracket and transom bracket.

Figure 1:
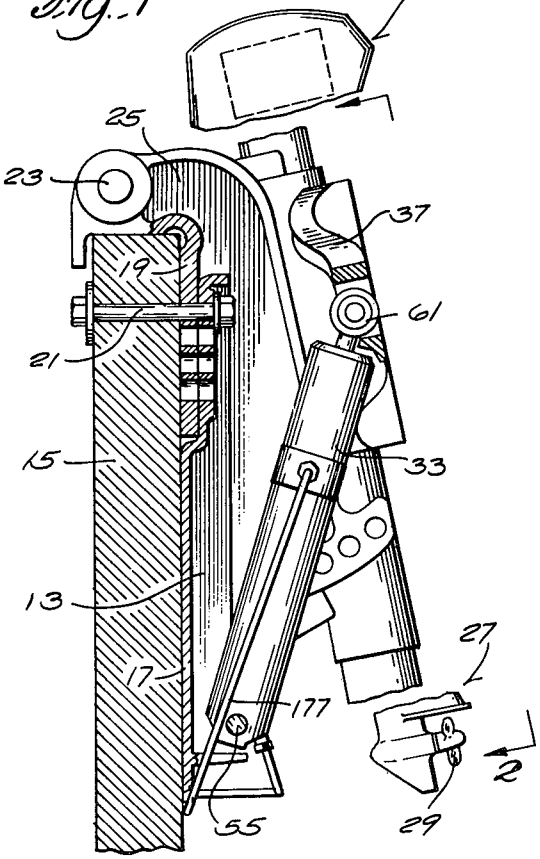
FIG. 1 is a fragmentary side elevational view, partially broken away and in section and partially schematically, of a marine propulsion device incorporating various of the features of the invention.
Figure 4:
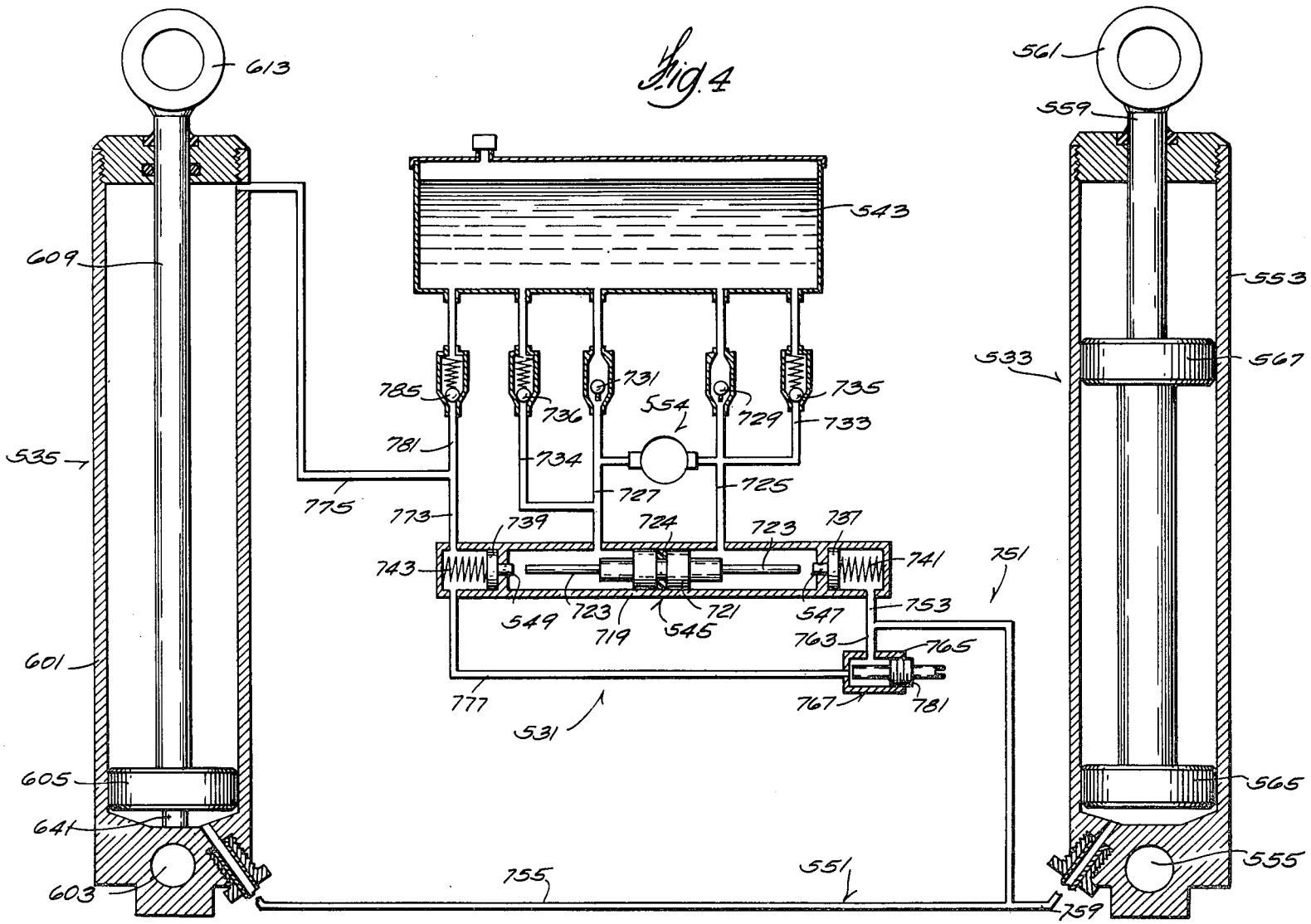
FIG. 4 is a schematic view illustrating another embodiment of a hydraulic system adapted to be incorporated in the marine propulsion device shown in FIGS. 1 and 2.

Schematically shown in FIG. 4 of the drawings is another hydraulic system 531 which is applicable to the outboard motor 11 shown in FIGS. 1 and 2 and which includes first and second hydraulic cylinder-piston assemblies 533 and 535 which, at their lower ends are adapted to be pivotally connected to the lower portion of the transom bracket 13 and which, at their upper ends, are adapted to be pivotally connected to the swivel bracket 25 through an attachment bracket 37 which is bolted at 39 or otherwise fixed to the swivel bracket 25.

The hydraulic system 531 also includes an electrically operated reversible pump 554 with an associated sump 543 and a main control or spool valve 545 operable in response to pressurized fluid and movable relative to two oppositely located first and second flow control ports 547 and 549, together with a conduit system 551 which connects the flow control ports 547 and 549 to the first and second hydraulic cylinder-piston assemblies 533 and 535.

Figure 5:
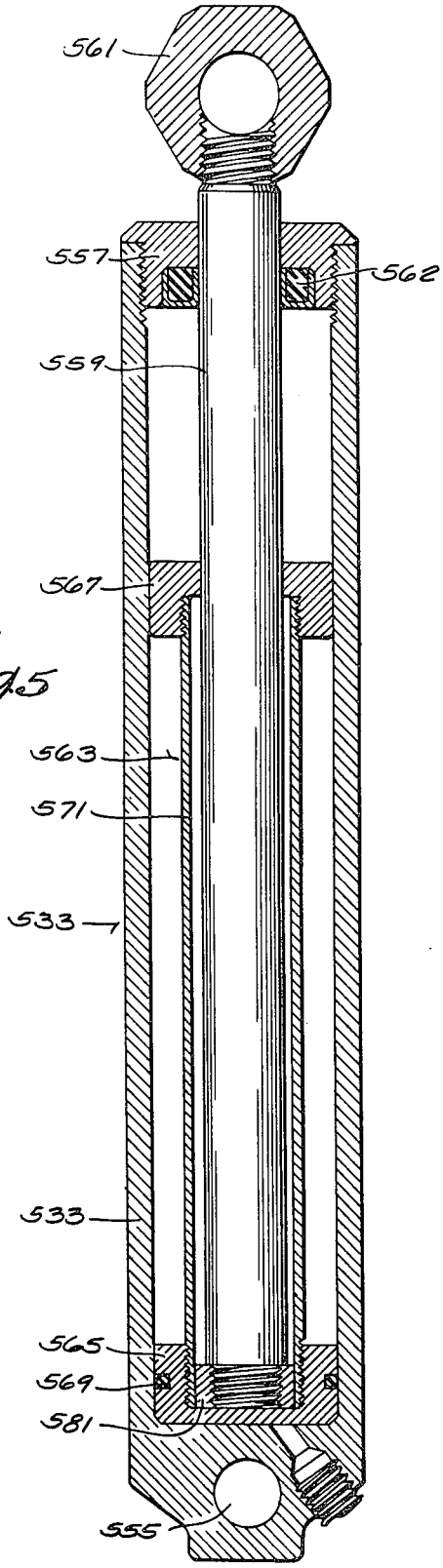
FIG. 5 is a sectional view of one of the hydraulic cylinder-piston assemblies incorporated in the system shown in FIG. 4.

More particularly, the first or trim hydraulic cylinder-piston assembly 533 comprises (see FIG. 5) a trim cylinder 553 which, in the illustrated construction, is closed at its lower end and includes an eye 555 which is intended to be pivotally attached to the transom bracket 13. At its upper end, the trim cylinder is closed by a threaded plug 557 through which there extends a piston rod 559 having, at its upper end, an eye 561 which is intended to be pivotally connected to the attachment bracket 37 or swivel bracket 25. Suitable seals 562 can be provided between the piston rod 559 and the plug 557. Such seals preferably permit escape of air from the cylinder 533 but prevent entry of air.

Contained within the trim cylinder 533 is a trim piston assembly 563 comprising two axially spaced lower end upper pistons 565 and 567 which are fixedly connected together by a tubular sleeve or tube 571 which, at its ends, is threaded into the lower and upper pistons 565 and 567. The lower piston 565 is non-apertured, and extends completely across the trim cylinder 533 and is preferably provided with a suitable piston ring 569 so as to prevent passage of fluid from one side thereof to the other at all times. The upper piston 565 is designed to permit gas flow from one side to the other and principally serves as a guide and to cause cessation of pistion assembly movement when the propulsion unit 27 reaches the upper end of the trim range. Means are provided for connecting the trim piston assembly 563 to the piston rod 559 so as to provide free relative axial movement therebetween. While other constructions could be employed, in the illustrated construction, such means comprises sliding receipt of the lower end of the piston rod 559 within the hollow interior of the piston assembly sleeve or tube 571.

Means are provided for effecting common movement of the piston rod 559 with the piston assembly 563 during outward trimming operation. While other arrangements are possible, in the illustrated construction, such means comprises engagement of the lower end of the piston rod 559 with the upper or inner surface of the lower piston 565.

Means are provided for guiding relative axial movement between the trim piston assembly 563 and the piston rod 559. While other constructions could be employed, in the illustrated construction, such means includes a bushing 581 which is carried at the lower end of the piston rod 559 and which is in engagement with the interior wall of the axial bore of the piston assembly sleeve 571. Upon trim cylinder extension, the bushing 581 also acts to prevent withdrawal of the piston rod 559 from the piston assembly 563 by engagement with the under surface of the upper piston 567.

The lower and upper pistons 565 and 567 are spaced apart at such distance as will cause the upper piston 567 to engage the threaded plug 557 when the propulsion unit 27 is at the upper end of the trim range.

Figure 6:
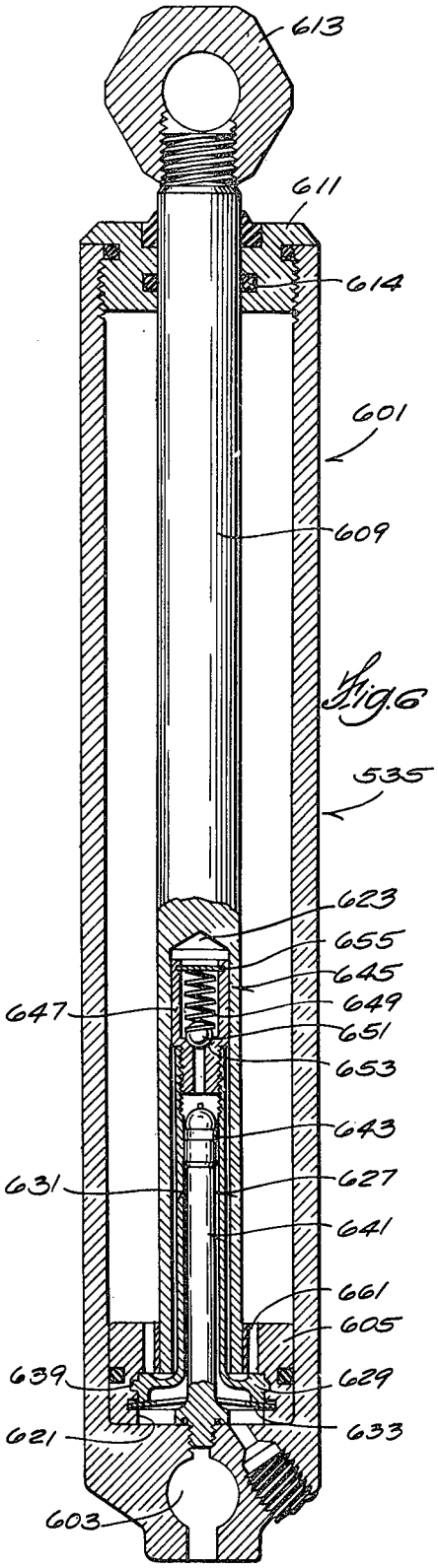
FIG. 6 is a sectional view of another of the hydraulic cylinder-piston assemblies incorporated in the hydraulic system shown in FIG. 4.

The second or tilt hydraulic cylinder-piston assembly 535 comprises (see FIG. 6) a tilt cylinder 601 which is closed at it lower end and which includes an eye 603 intended to be pivotally connected to the transom bracket 13. The second hydraulic cylinder-piston assembly 535 also includes a piston 605 which is slidable in the tilt cylinder 601, which is preferably provided with a piston ring 607, and which is fixedly connected to a piston rod 609 for common movement therewith. The piston rod 609 passes out of the tilt cylinder 601 through a plug 611 screwed into the cylinder top and is provided, at its upper or outer end, with an eye 613 which is intended to be pivotally connected to the attachment bracket 13 or swivel bracket 25. Suitable seals 614 can be provided between the piston rod 609 and the plug 611 to prevent fluid loss.

Included in the tilt cylinder 601 is means for affording hydraulic flow from one side fo the piston 605 to the other in the event that excessive thrust is provided by the propeller 27 when the propulsion unit 27 is located in the tilt range.

While other specific constructions could be employed in accordance with the invention, in the illustrated construction, such means comprises formation of the piston 605 with a cylindrical recess 621 which extends from the undersurface of the piston 605 and which communicates with a blind bore 623 extending axially in the piston rod 609. Carried by the piston 605 is a valve guide 627 which includes a base or flange 629 received in the piston recess 621 and a hollow sleeve or tube 631 which extends from the flange 629 into the piston rod bore 623. The valve guide 627 is retained in the piston recess 621 and in the piston rod bore 623 by a snap ring 633 seated in the piston recess 621 below the valve guide flange 629. The snap ring 633 is located to allow a limited amount of movement of the valve guide 627 axially of the piston rod 609 and assembled piston 605. In addition, the flange 629 is dimensioned so as to be received in the cylindrical recess 627 in such manner as to afford limited angular movement therebetween. In this regard, there is located between the flange 629 and the cylindrical wall of the piston recess 621 an O-ring 639 which normally prevents fluid flow from one side to the other of the valve guide flange 629.

Projecting from the bottom wall of the tilt cylinder 601 is a valve stem 641 which projects, when the propulsion unit 27 is in the trim range, within the hollow interior of the valve guide 627 and which carries a seal member 643 which engages and seals with the inner wall of the valve guide 627 when the propulsion unit 27 is in the trim range. However, upon movement of the propulsion unit 27 into the tilt range, the valve guide 627 is withdrawn from position affording receipt of the valve stem 641, and the valve stem interior becomes subject to the fluid pressure in the bottom of the tilt cylinder 601.

Carried at the axially inner end of the valve guide 627 is a spring biased check valve 645 which affords flow from within the valve guide 627 to within the piston rod bore 623 when the pressure in the bottom of the tilt cylinder 601 exceeds a predetermined level associated with a predetermined forward thrust condition generated by the propeller 29. More specifically, the check valve 645 is housed in a counterbored member 647 screwed or otherwise fixed to the inner end of the valve-guide 627 and includes a spring 649 seating a ball 651 against a valve seat 653 formed by a shoulder. In addition, the spring 629 is retained in the member 647 by a snap ring 655. In the absence of excessive fluid pressure in the valve guide 627, the check valve 645 remains closed.

Upon opening of the check valve 645, as, for instance, when attempting the propel the boat at too fast a forward speed when the propulsion unit 27 is in the tilt range, hydraulic fluid will flow through the bored member 647, will flow downwardly in the annular space between the outer surface of the valve guide 627 and the inner wall of the piston rod bore 623, and directly through one or more ports 661 which extend from the upper wall or top of the piston recess 621 to the top side of the piston 605. Thus, under conditions of excessive pressure in the tilt cylinder 601 when the propulsion unit 27 is in the tilt range, bypass of fluid from one side to the other of the piston 605 is permitted and, at the same time, the tilt cylinder 601 will contract until the trim range is reached or the forward thrust condition is reduced. Excess oil flowing from the lower side to the top of the piston during contraction is vented to the sump 543 through the check valve 785 hereinafter mentioned.

While other constructions are possible, in the illustrated construction as shown best in FIG. 4, the main control valve 545 comprises a spool which is shiftable axially in a closed tubular valve housing 719 and which includes a central piston portion 721 and two oppositely extending plunger portions 723. A seal 724 is preferably provided between the piston portion 721 and the valve housing 719. The main valve housing 719 is connected to the opposite sides of the pump 541 by respective flow passageways or ducts 725 and 727 which extend from ports in the valve housing 719 on opposite sides of the piston portion 721 of the spool 545. The ducts 725 and 727 communicate with the sump or reservoir 543 subject to the action of eespective ball check valves 729 and 731 which selectively permit flow from the sump 543 and prevent flow to the sump 543. In addition, the duct 725 communicates with a duct 733 which includes a spring biased check valve 735 preventing flow from the sump 543 to the duct 725 but affording flow from the duct 725 to the sump 543 in the event of a pressure in the duct 725 above a predetermined level. Still further in addition, the duct 727 communicates with a duct 734 which includes a spring biased check valve 736 preventing flow from the sump 543 to the duct 727 but affording flow from the duct 727 to the sump 545 in the event of a pressure in the duct 727 above a predetermined level.

Provided in the main valve housing 719 in opposite relation to each other on opposite sides of the spool 545 are the first and second flow control ports 547 and 549 which are each provided with respective valve members 737 and 739 biased by respective springs 741 and 743 into closed positions, as shown in FIG. 4.

The conduit system 551 includes a first conduit means 751 which generally communicates between the first flow port 547 and the lower part of the cylinders 553 and 601 and which includes a main duct 753 communicating with the first flow port 547, a branch duct 755 communicating with the main duct 753 and with the lower end of the tilt cylinder 601, a second branch duct 759 communicating with the main duct 753 and with the lower end of the trim cylinder 553, and a third branch duct 763 communicating with the main duct 753 and with a housing 765 for a manual release valve 767.

The conduit system 551 also includes a second conduit means 771 which communicates with the second flow port 549 and which includes a main duct 773 communicating with the second flow port 549, a first branch duct 775 communicating with the main duct 773 and with the upper end of the tilt cylinder 601, a second branch duct 777 communicating with the main duct 773 and with the release valve housing 765, and a third branch duct 781 communicating with the main duct 773 and with the sump or reservoir 543.

The third branch duct 781 also includes a spring biased check valve 785 preventing flow from the sump 543 to the main duct 773 and permitting flow from the main duct 773 to the sump 543.

The manual release valve 767 comprises a valve member 787 which is rotatable within the housing 765 between a first or open position affording comunication between the third branch duct 763 of the first conduit means 751 and the second branch duct 777 of the second conduit means 771, thereby to short circuit the hydraulic system 531, and a second or closed position preventing such communication. When the manual release valve 767 is open, the propulsion unit 27 and connecting swivel bracket 25 can be manually raised and lowered.

In operation, to provide trim adjustment in the upward direction, the pump 554 is operated to provide pressure fluid through the duct 725. In the spool valve housing 719, such pressure fluid serves to displace the spool 545 to the left, as seen in FIG. 4, and thereby to open the second flow port 549 by reason of engagement of the left plunger 723 against the valve member 739. In addition, such pressurized fluid in the spool valve housing 719 acts to open the first flow port 547 by displacing the valve member 737 out of the first flow port 547 and to consequently provide pressure fluid to the first conduit means 751 and delivery of pressure fluid to the lower part of each of the trim and tilt cylinders 553 and 601, thereby extending the cylinder-piston assemblies 533 and 535 and raising the propulsion unit 27 and connected swivel bracket 25 through the trim range. During upward movement through the trim range, the pressure fluid in the top of the tilt cylinder 601 exits through the second conduit means 771, through the second flow port 549, and through the duct 727 to the suction side of the pump 541.

As the propulsion unit 27 and connected swivel bracket 25 approach the upper end of the trim range, the piston assembly 563 in the trim cylinder 553 approaches the upper end of the trim cylinder 553. At the same time, the valve stem 641 withdraws from the valve guide 627 in the tilt cylinder 601. When the end of the trim range is reached, the piston assembly 563 engages the plug 557 at the upper end of the trim cylinder 553 to prevent further upward movement of the piston assembly 563. Thereafter, during movement through the tilt range, the entire output of the pump 41 is directed to the tilt cylinder 601. During such extension of the tilt cylinder-piston assembly 535, the piston rod 559 of the trim cylinder-piston assembly 533 withdraws from the sleeve 571 of the piston assembly 563.

When the upper end of the tilt range is reached, the tilt piston 605 engages the plug 611 in the tilt cylinder 601, and further operation of the pump 641 serves only to increase the pressure in the hydraulic system 631 to the point where the control or check valve 735 in the duct 733 opens to permit flow of pressure fluid to the sump 543, and thereby to relieve excessive pressure.

When the pump 541 is turned off, the springs 741 and 743 at the opposite ends of the spool valve housing 719 operate to cause both valve members 737 and 739 to close both flow ports 547 and 549 and to hydraulically lock the propulsion unit 27 and connected swivel bracket 25 against further movement in the absence of pump operation or movement of the release valve 767 to the open position. Accordingly, in order to lower the propulsion unit 27 and connected swivel bracket 25, the pump 541 is operated in the other direction to pressurize the duct 727, and the spool valve housing 719 so as to displace the spool 545 to the right and to open the first flow port 547 by engagement of the right plunger 723 with the valve member 737. In addition, the pressure fluid in the housing 719 seves to open the second flow port 549 to enable pressure fluid flow through the second conduit means 771 and, in particular, through the first branch duct 775 to the top of the tilt cylinder 601. Flow of pressure fluid to the top of the tilt cylinder 601 serves to displace the tilt piston 605 downwardly and to lower the propulsion unit 27 and connected swivel bracket 25. As the first flow port 547 is opened by operation of the spool 545, the pressure fluid in the lower part of each of the cylinders 553 and 601 is free to return through the first conduit means 751 and through the duct 725 to the suction side of the pump 541.

Flow of pressurized fluid through the third branch duct 781 of the second conduit means 771 and into the sump 543 is normally prevented by the check valve 785. However, in the event the propulsion unit 27 strikes an underwater obstacle, the pressure in the second conduit means 771 will rise very rapidly and will consequently cause opening of the check valve 785 in the third branch duct 781 to communicate the second conduit means 771 with the sump 543 and to permit oil to flow out of the top of the tilt cylinder 601 so as to permit upward swinging of the propulsion unit 27 and connected swivel bracket 25. When the obstacle is passed the propulsion unit 27 and connected swivel bracket 25 are free to return by gravity to the previously set position as there has been no change in the quantity of oil in the lower parts of the cylinders 553 and 601. In addition, the spring loaded check valve 785 is designed so as to resist opening and to permit limited transmission of thrust through the tilt cylinder 601 when the outboard motor is operating in reverse. The check valve 785 also vents fluid during operation at excessive rearward thrust and at excessive forward thrust when the outboard motor is in the tilt range after opening of the check valve 645 as already referred to.

The spring loaded check valve 736 serves as a pressure relief valve and limits the pressure produced when pumping down as very little pressure is needed due to the weight of the propulsion unit. More specifically, under normal conditions, the spring biasing the check valve 736 retains the check valve 736 closed. However, when the tilt piston 605 bottoms out at the bottom of the tilt cylinder 601 or should there be some obstruction to downward movement of the propulsion unit 27 and connected swivel bracket 25, the spring associated with the check valve 736 is designed to afford opening of the check valve 736 when the pressure in the second conduit means 771 rises a predetermined amount above that normally effective to cause lowering of the propulsion unit 27 and connected swivel bracket 25.

As the amount of pressure fluid drained from the bottom of the tilt cylinder 601 during the lowering of the propulsion unit 27 and connected swivel bracket under operation of the pump is greater than that which is supplied to the top of the tilt cylinder 601, the excess oil drained from the tilt cylinder 601 pressurizes the suction side of the pump 541 and is delivered under pump pressure to the sump 543 through the check valve 736.

In both embodiments, when operating in the trim range, both cylinder-piston assemblies are active in raising the propulsion unit 27 and connected swivel bracket 25. However, in the tilt range, only the tilt cylinder-piston assembly is active to raise the propulsion unit 27. It is further noted that the thrust generated by the propulsion unit propeller 29 is transmitted through both cylinder-piston assemblies when the propulsion unit 27 is in the trim range. In addition, when in the tilt range, the trim piston assembly is continuously located adjacent the top of the trim cylinder and the trim piston rod moves axially relative to the trim piston assembly in accordance with movement of the propulsion unit 27 and connected swivel bracket 25. Still further, during downward operation, the trim piston assembly floats on oil in the lower part of the trim cylinder while the oil is free to flow to the sump and thus hydraulic lowering of the propulsion unit 27 is effectively controlled by the tilt cylinder. In addition, downward movement of the propulsion unit in the tilt range mechanically causes insertion of the piston rod into the trim cylinder piston assembly and, in the trim range, mechanically causes continued inward movement of the piston rod accompanied by the piston assembly.

Various of the features of the invention are set forth in the following claims.

We claim:

1. A single acting hydraulic cylinder-piston assembly comprising a cylinder having first and second ends, and a constantly open vent opening adjacent to said second end of said cylinder, a piston assembly located in said cylinder for movement axially thereof and including a first piston sealingly engaged with said cylinder, located adjacent to said first end of said cylinder, and having therein a port, a second piston sealingly engaged with said cylinder and spaced axially from said first piston and located adjacent to said second end of said cylinder, tubular means connecting said first and second pistons said first and second pistons and said tubular means defining therebetween an annular space, a piston rod, said piston rod being mounted within said tubular means for limited axial movement relative to said pistons and cylinder, a first hydraulic fluid fitting adjacent said first end of said cylinder, a second hydraulic fluid fitting on said cylinder intermediate said first and second pistons and communicating with said annular space at all positions of said piston assembly in said cylinder, valve means normally closing said port, and position responsive means for operating said valve means to open said port upon movement of said piston assembly to adjacent said second end of said cylinder, said valve means includes a valve member, and said operating means comprises an axially extending bore in said second piston and a valve stem on said valve member and extending through said bore in said second piston for engagement with said second end of said cylinder upon movement of said piston assembly to adjacent said second end of said cylinder.

2. A hydraulic cylinder-piston assembly in accordance with claim 1 and further including spring means releasably biasing said valve member to close said port when said valve stem is spaced from said second end of said cylinder.

* * * * *